US009038559B2

(12) United States Patent
Abella et al.

(10) Patent No.: US 9,038,559 B2
(45) **Date of Patent: *May 26, 2015**

(54) KEEL PAD, BOAT HULL WITH A KEEL PAD AND RETROFIT KIT

(71) Applicant: PROP IT RITE BOAT CONSULTING SERVICES INC., Opa-Locka, FL (US)

(72) Inventors: Jose Abella, Hollywood, FL (US); Jorge Valderrama, Hollywood, FL (US)

(73) Assignee: Prop It Rite Consulting Services, Inc., Opa Locka, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/045,251

(22) Filed: Oct. 3, 2013

(65) Prior Publication Data

US 2014/0102349 A1 Apr. 17, 2014

Related U.S. Application Data

(63) Continuation-in-part of application No. 29/434,671, filed on Oct. 16, 2012, now Pat. No. Des. 714,711.

(60) Provisional application No. 61/871,015, filed on Aug. 28, 2013.

(51) Int. Cl.

| | |
|---|---|
| ***B63B 3/38*** | (2006.01) |
| *B63B 1/18* | (2006.01) |

(52) U.S. Cl.

CPC ..... *B63B 3/38* (2013.01); *B63B 2001/183* (2013.01)

(58) Field of Classification Search

CPC ..... B63B 2001/183; B63B 3/38; B63B 1/20

USPC ..... 114/271, 288

See application file for complete search history.

(56) References Cited

U.S. PATENT DOCUMENTS

| | | | | |
|---|---|---|---|---|
| 3,138,130 | A * | 6/1964 | Morgan | 114/57 |
| 3,698,342 | A * | 10/1972 | Jackson | 114/288 |
| 3,776,168 | A * | 12/1973 | Weeks | 114/271 |
| 4,263,866 | A | 4/1981 | Shirley | |
| 4,958,585 | A | 9/1990 | Caldwell, Jr. | |
| 5,468,165 | A * | 11/1995 | Weber et al. | 440/46 |
| 2013/0152843 | A1 * | 6/2013 | Connett et al. | 114/258 |

* cited by examiner

*Primary Examiner* — Edwin Swinehart

(74) *Attorney, Agent, or Firm* — Laurence A. Greenberg; Werner H. Stemer; Ralph E. Locher

(57) ABSTRACT

A keel pad is provided for a hull of a boat. The keel pad contains a main body and two fingers extending from the main body in a direction of a front of the hull. Due to curved shape of the fingers, drag is reduced allowing the boat better planing properties and greater fuel efficiencies.

20 Claims, 7 Drawing Sheets

KEEL PAD, BOAT HULL WITH A KEEL PAD AND RETROFIT KIT

CROSS-REFERENCE TO RELATED APPLICATION

This application is a continuation-in-part of copending U.S. patent application Ser. No. 29/434,671, filed Oct. 16, 2012. This application also claims the priority, under 35 U.S.C. §119, of U.S. provisional patent application No. 61/871,015, filed Aug. 28, 2013; the prior applications are herewith incorporated by reference in its entireties.

BACKGROUND OF THE INVENTION

Field of the Invention

The invention relates, generally, to a keel pad, and more specifically, it relates to a retrofit kit for a boat hull and to a boat hull having an integrated keel pad.

A boat hull is ideally configured to reduce drag, increase lift, maximize speed and maximize fuel economy. A key feature of the boat hull that influences these properties is the keel pad integrated on the bottom of the boat hull. Increased speed is generally obtained by minimizing the drag on the hull and by increasing the lift of the hull so that the hull planes over the water at high speeds. Drag is generally minimized by decreasing the wetted area of the hull. However, decreasing drag and increasing lift usually adversely affects comfort and handling.

With regards to larger boats, being defined as boats larger than 35 plus feet, fuel economy is also a major concern and is influenced by the configuration of the keel pad. The purpose of a keel pad is to increase lift locally in an aft portion of a marine planing craft that has a dead rise angle greater than zero. The more increased lift, the less drag resulting in great speed and better fuel efficiency.

SUMMARY OF THE INVENTION

It is accordingly an object of the invention to provide a keel pad, a boat hull with a keel pad and a retrofit kit that overcome the herein-mentioned disadvantages of the heretofore-known devices of this general type, which increases fuel economy, increases lift and does not decrease handling characteristics.

With the foregoing and other objects in view there is provided, in accordance with the invention, a keel pad for a hull of a boat. The keel pad contains a main body and two fingers extending from the main body in a direction of a front of the hull. Because the keel pad ends in the shape of two fingers rather than a traditional triangular tip shape drag is surprisingly reduced and fuel economy improves. Ideally, these improvements occur because the two fingers define a V-shaped entry between the two fingers as viewed looking forward towards the front of the hull. This is further enhanced because the two fingers have inner sides tapering towards each other which reduces water flow turbulence.

In a preferred embodiment of the invention, the main body has an elongated rectangular shape which results in greater surface area than prior art keel pads which provides greater lift thus reducing drag.

In an added embodiment of the invention, the main body has a given length L1, the fingers each has a given length L2, and the following equation holds for L2:

$$0.25L1<L2<2L1.$$

In another embodiment of the invention, the main body has a given length L1, the fingers each has a given length L2, and the overall length of the keel pad is L3 where L3=L1+L2, and the hull has a given length $L_{OA}$. Therefore the following equation holds true for the overall length L3:

$$0.05L_{OA}<L3<0.5L_{OA}.$$

In a further embodiment of the invention, the keel pad is configured to be either integrated in the hull of a new boat or retrofitted on the hull over an existing keel pad of an existing boat. In order to be attached to an existing hull, the keel pad may have a flange extending along its side so that it may be attached to the hull by an adhesive, rivets, screws and other fastening methods. Instead of a flange extending from the sides, the surface area of the bottom of the keel pad can be adhesively attached to an existing hull.

In an added feature of the invention, the two fingers each slope downward towards the hull in a frontal region of the keel pad. This further decreases drag and increases fuel efficiency.

With the foregoing and other objects in view there is provided, in accordance with the invention, a boat. The boat contains a hull with a front and a transom, and a keel pad extending from the hull. The keel pad has a main body and two fingers extending from the main body in a direction of the front of the hull.

In a preferred embodiment of the invention, the main body has a given width $W_{KP}$, the hull has a given chine beam width $W_{CB}$ and a given length $L_{OA}$. The given width $W_{KP}$ is defined by the following equation:

$$0.05W_{CB}<W_{KP}<0.5L_{OA}.$$

Other characteristic features of the invention are set forth in the appended claims.

Although the invention is illustrated and described herein as embodied in a keel pad, a boat hull with a key pad and a retrofit kit, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
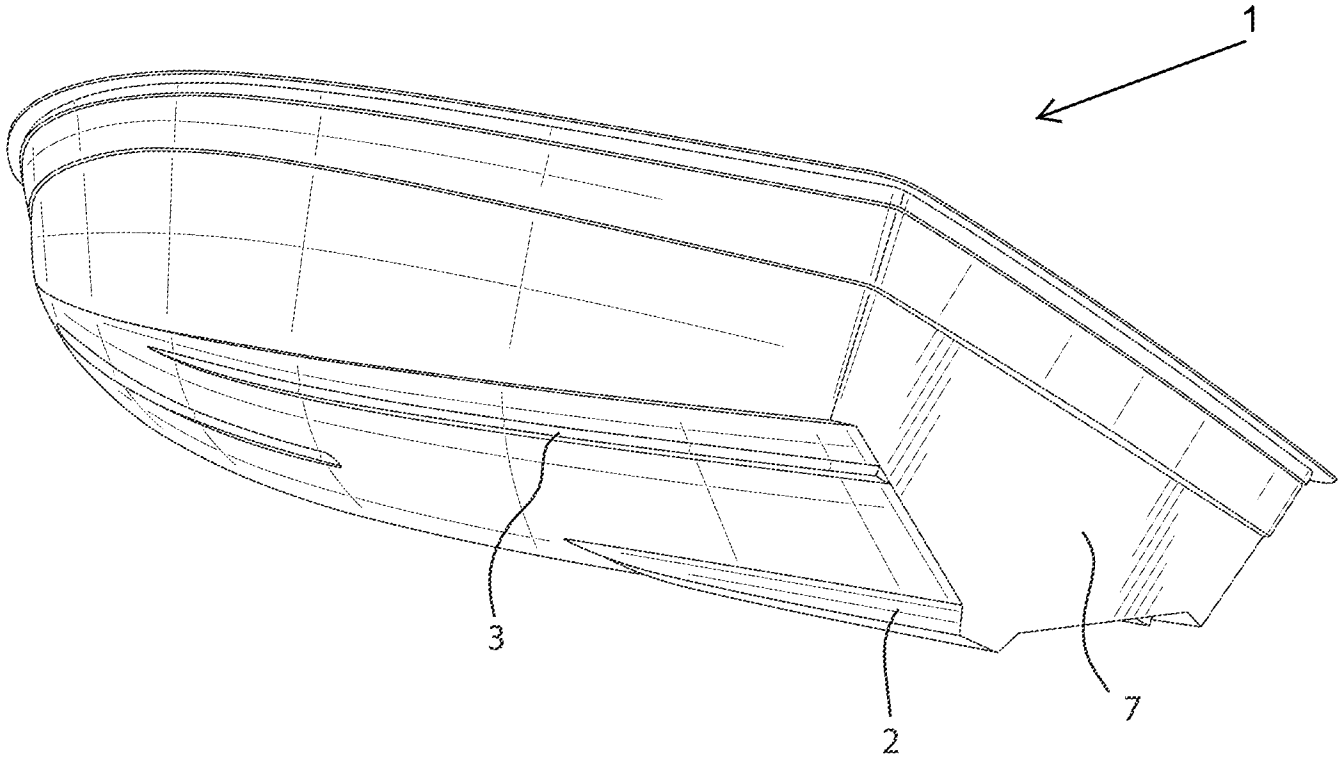
FIG. 1 is a diagrammatic, perspective side view of a boat hull according to the invention.

In all the figures of the drawing, sub-features and integral parts that correspond to one another bear the same reference symbol in each case. Referring now to the figures of the drawings in detail and first, particularly, to FIG. 1 thereof, there is shown a boat hull 1 with an inventive keel pad 2, lift strakes 3 and a transom 7 (rear of the boat hull). The boat hull 1 is of a generalized V-hull shape.

Figure 2:
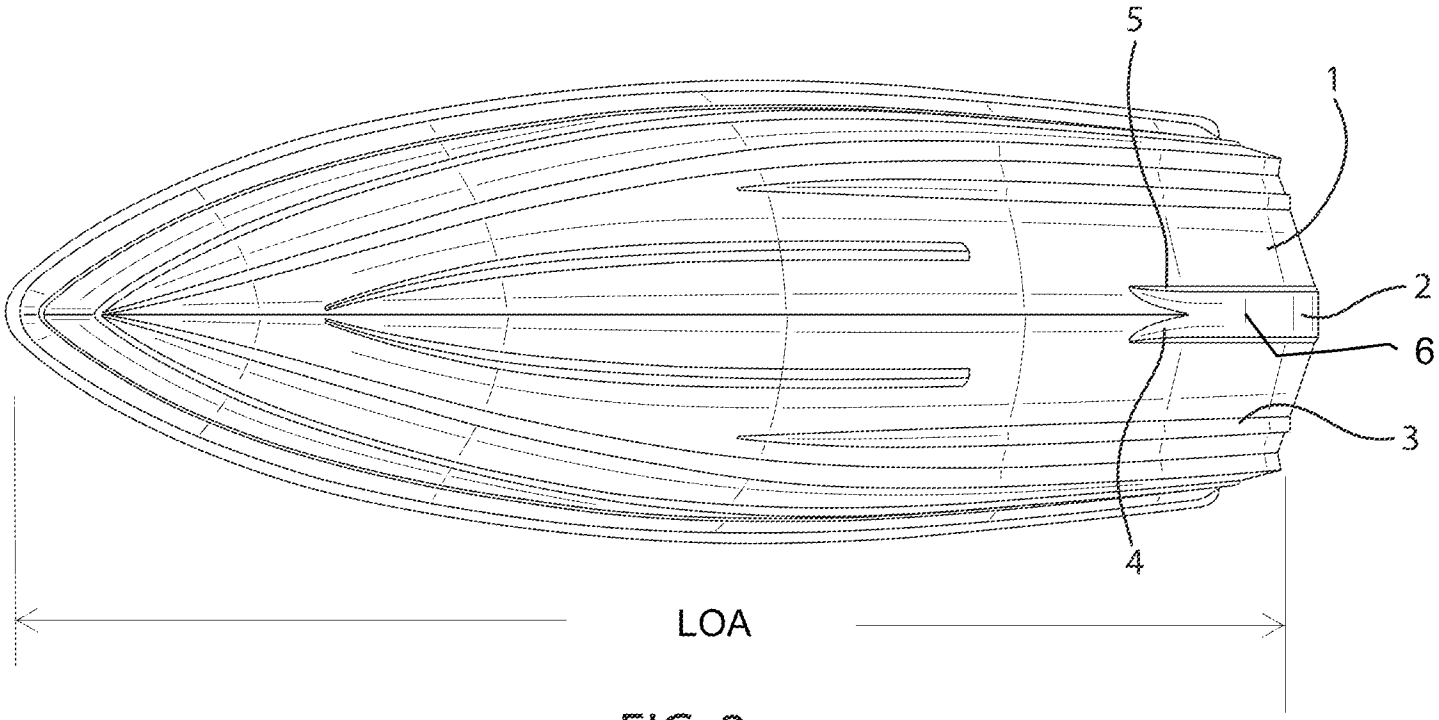
FIG. 2 is a diagrammatic, perspective bottom view of the boat hull according to the invention.

FIG. 2 shows a bottom view of the boat hull 1 with the inventive keel pad 2.

There are several factors to consider when trying to increase lift with a keel pad. These include:

a). first, increasing an effective lifting surface area;

b). second, minimizing drag due to the keel pad;

c). third, maintaining a vessel's ability to linearly track; and d). fourth, maintaining or increasing aft buoyancy.

In addition, the ability to retro fit a vessel with an appropriate keel pad is also a factor in the design of the keel pad.

We first turn our attention to increasing the lifting surface area of the boat hull. It is known that the surface for a given area that provides the most lift is a flat surface. Unfortunately flat surfaces do not have good sea keeping and hinder fast accelerations, therefore most planing sea going vessels have some sort of "V" shaped hull. Sea keeping ability is a measure of how well-suited a watercraft is to conditions when underway (ability to turn and maintain a straight linear path in view of wave forces). A ship or boat which has good sea keeping ability is said to be very seaworthy and is able to operate effectively even in high sea states. The angle of the V is called the deadrise. The V-shape of the hull is typically sharp at the bow and reduces gradually towards a stern, but still maintains a deadrise angle at the transom 7. In some vessels it is desirable to gain lift at the aft end of the vessel for various reasons such as reducing the running trim angle, and to vertically translate the vessel higher out of the water while running, etc. in order to increase performance. There is a mathematical relationship to represent the increase in lift given a fixed pressure on a given inclined area of the deadrise:

$$\text{Percent Increase Lift Force} = \text{Pressure} \times \text{Area} / (\text{Pressure} \times \text{Area} \times \text{Cos}(\text{deadrise angle})).$$

It can be observed that as the deadrise angle approaches zero (or a flat surface) the equation goes to unity.

Second, we turn our attention to minimizing drag due to the addition of the keel pad. By the nature of the addition of the keel pad there will be an inherent drag component. This is due to the added surface area of the keel pad obstructing the flow of bypassing water. The frontal area of the keel pad creates the most drag and disturbs the water flow resulting in a creation of negative pressures relative to the rest of the hull. To minimize the surface area of the keel pad is therefore thought to be obvious. The frontal drag component is most influenced and reduced by the shaping of the frontal area. Lastly, the water flow when made to change direction frequently or abruptly can cause increased drag, so it is best to make the flow as uniform as possible when flowing over sections.

Third, we turn our attention to maintaining the vessel's ability to linearly track. A flat bottom boat has difficulty to linearly track and slides outs in turns. The addition of a keel pad can cause the same characteristic to a lesser degree due to the flat section if not properly addressed. Some shapes can provide some linear tracking, but have a tendency to be unstable in either turns and/or with wave incident angles other than head on.

Fourth, we turn to the ability to maintain or increase buoyancy. Often it is desirable to at least maintain current hydrostatic characteristics (e.g. pressure) or increase the buoyancy as this helps with static trim and as well as the running trim of the vessel if combating a stern down condition.

A further consideration in the configuration of the keel pad relates to the ability to retro-fit the keel pad onto existing boat hulls. In other words, the need for the keel pad to be added after the vessel has been built. In this case it is important to have a shape that can be easily retro-fitted without compromising the hulls integrity, preferably a piece that can be added in lieu of cutting an existing hull.

Turning now to FIGS. 3-8, there are shown designs of three prior art keel pads.

Figure 3:
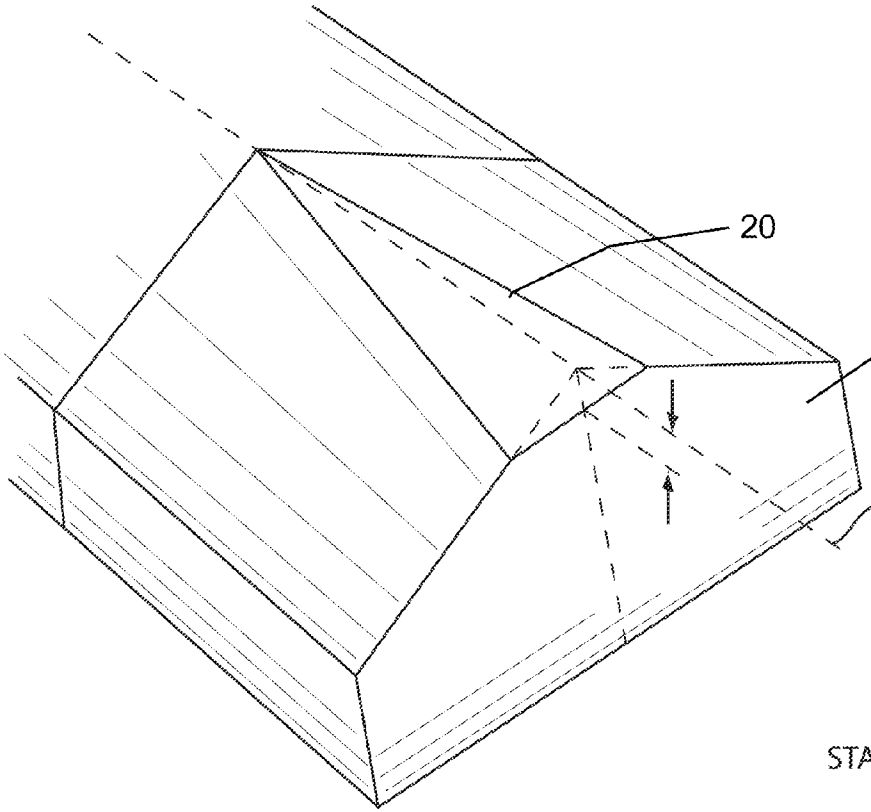
FIG. 3 PRIOR ART
FIG. 3 is a bottom perspective view of a recessed delta keel pad according to the prior art.
Figure 4:
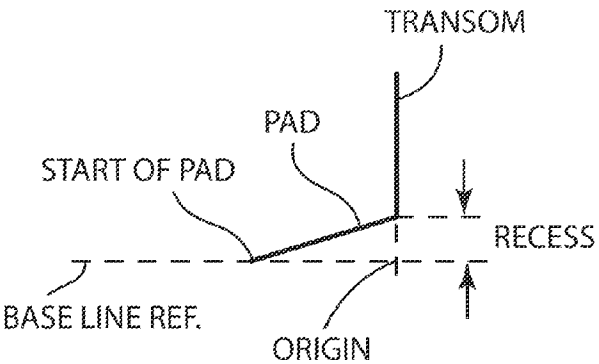
FIG. 4 PRIOR ART
FIG. 4 is a side view of the recessed delta keel pad according to the prior art.

The keel pad shown in FIGS. 3 and 4 is known as a recessed (delta) keel pad 20. The recessed keel pad 20 is triangular in shape and extends from the transom forward to a tip of the recessed keel pad 20. The recess keel pad 20 is integrated in the hull of the boat. More specifically, the stern and bottom area of the V-shaped hull is flattened (molded) in a flat triangular shape to form the recessed keel pad 20.

The recessed keel pad 20 results in a decrease in buoyancy and generates negative pressure unless the vessel is trimmed to the same angle as the recessed keel pad 20. Unfortunately the recessed keel pad 20 provides no or poor linear tracking and causes the stern to slide out in turns.

Figure 6:
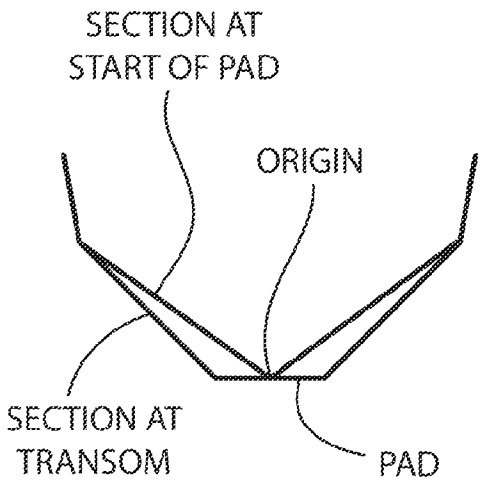
FIG. 6 PRIOR ART
FIG. 6 is a rear view of the warp delta keel pad according to the prior art.
Figure 5:
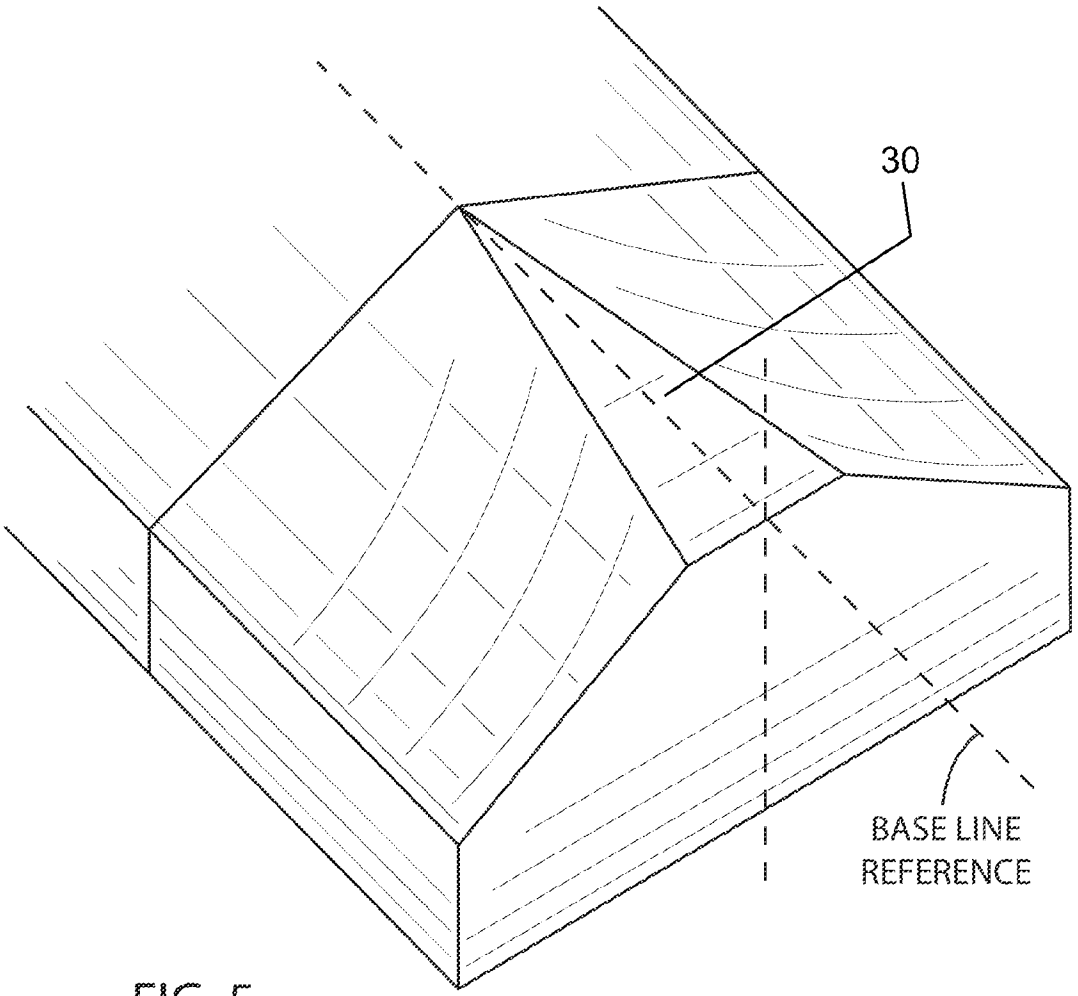
FIG. 5 PRIOR ART
FIG. 5 is a bottom perspective view of a warp delta keel pad according to the prior art.

The keel pad shown in FIGS. 5 and 6 is known as a warped (delta) keel pad 30. Like the recessed keel pad 20, the warped key pad 30 is also triangular shaped and extends from the transom 7 to the tip of the warped key pad 30. The warped key pad 30 is also integrated into the hull as the sides of the V-shaped hull are warped or widened out and the warp keel pad 30 extends between the widened out portions.

The warped keel pad 30 adds extra buoyancy and a warped surface frontal area. Due to the nature of the orientation of the warped surface, the warped keel pad 30 produces instability in linear tracking and creates significant bow down and possible hooking. Hooking is the occurrence of an unexpected sharp turn (e.g. 90 degree turn) of the boat while underway. In addition, due to the shape of the warped keel pad 30, the water flow is forced to change direction continually and therefore causes additional drag.

Figure 7:
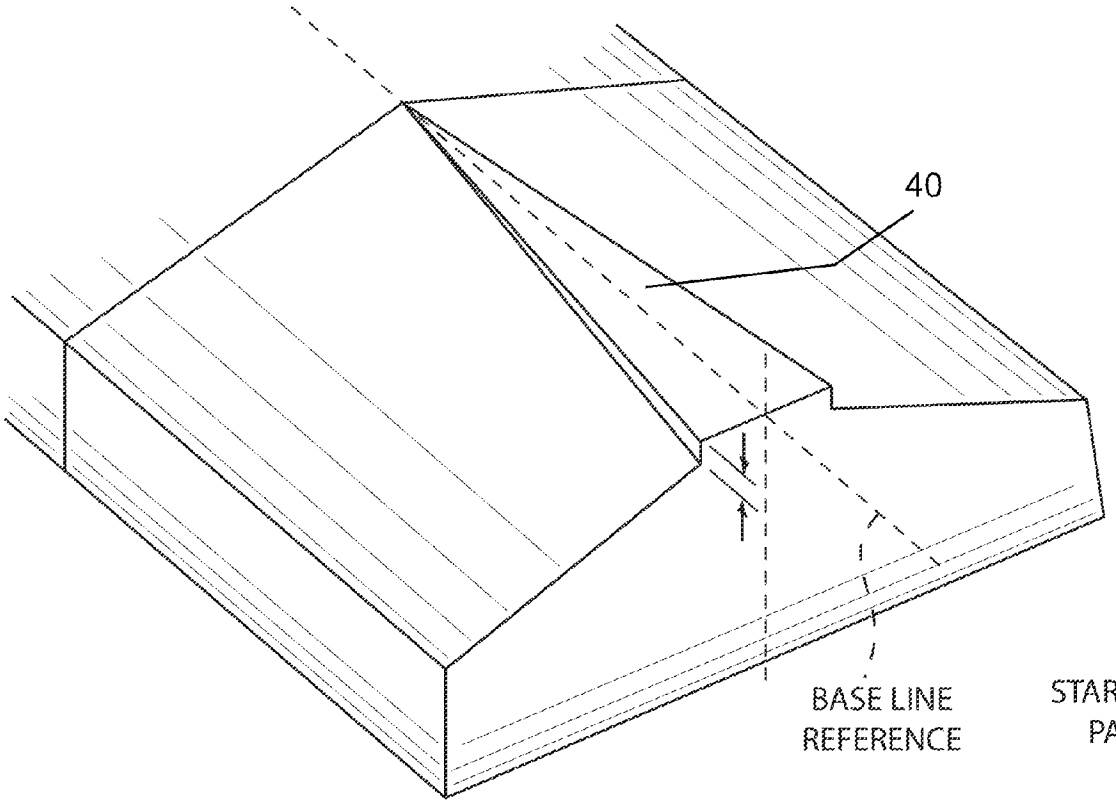
FIG. 7 PRIOR ART
FIG. 7 is a bottom perspective view of a protruding delta keel pad according to the prior art.
Figure 8:
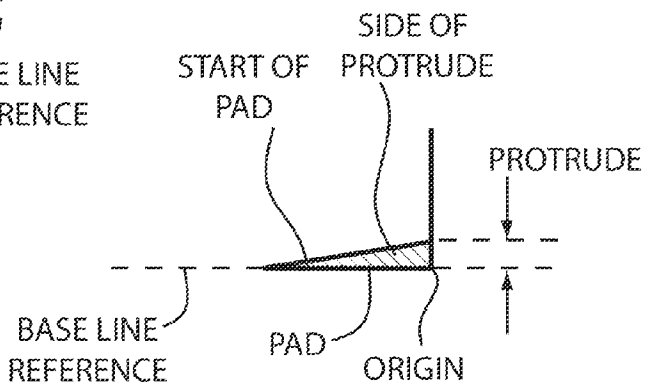
FIG. 8 PRIOR ART
FIG. 8 is a side view of the protruding delta keel pad according to the prior art.

The keel pad shown in FIGS. 7 and 8 is a protruding (delta) keel pad 40. Like the other keel pads 20, 30, the protruding keel pad 40 is also triangular shaped but extends below the natural boundaries of the V-shaped hull. The protruding keel pad 40 provides added buoyancy and added frontal area. However, the frontal area does not generate any additional lift, rather it generates drag. The angled vertical surface of the protruding keel pad 40 does provide increased linear tracking but also creates instability in certain conditions where the wave incident angle is unfavorable.

Figure 9:
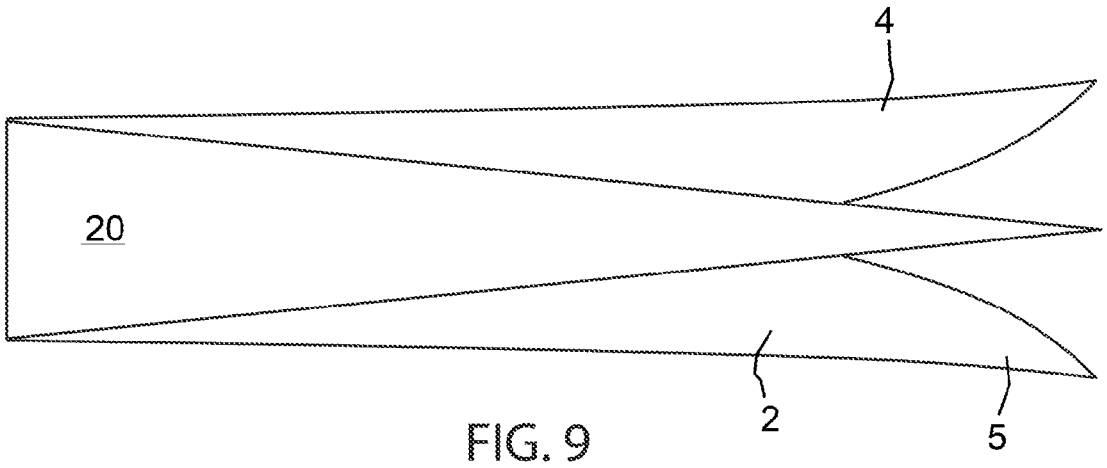
FIG. 9 is a plan view of one of the delta keel pads overlaid on the keel pad according to the invention.

FIG. 9 is a plan view of one of the prior art keel pads having the delta or triangular shape overlaid on the keel pad 2 according to the invention. First, as you can see from the overlay, the keel pad 2 according to the invention has a greater surface area and therefore a more effective lifting surface than the prior art delta shaped keel pads 20. Of course in the case of a retrofit, the keel pad 2 would have to be elongated to completely cover the prior art keel pad 20, 30, 40 so that the tip is disposed in the main body.

Second, drag is reduced by creating a shape for the frontal area that also provides lift and minimizes the drag component. The water flow is also kept as uniform as possible with minimal directional changes. This occurs because the keel pad 2 ends not in a tip shape but rather has two fingers 4, 5.

Third, the front of the inventive keel pad 2 ends in an inverted V shape in combination with the sides of the keel pad 2 which provides stable linear tracking.

Fourth, due to the nature of the shape, the inventive keel pad 2 can easily be retro-fitted to hulls without jeopardizing hull integrity. The keel pad 2 can be adhered to an existing hull by adding side flanges to the keel pad 2 and then riveted, glued, screwed, and/or fastened to the hull over the existing keel pad.

Fifth, the buoyancy of the boat is increased because it does not experience additional drag found from the prior art keel pads.

Figure 10:
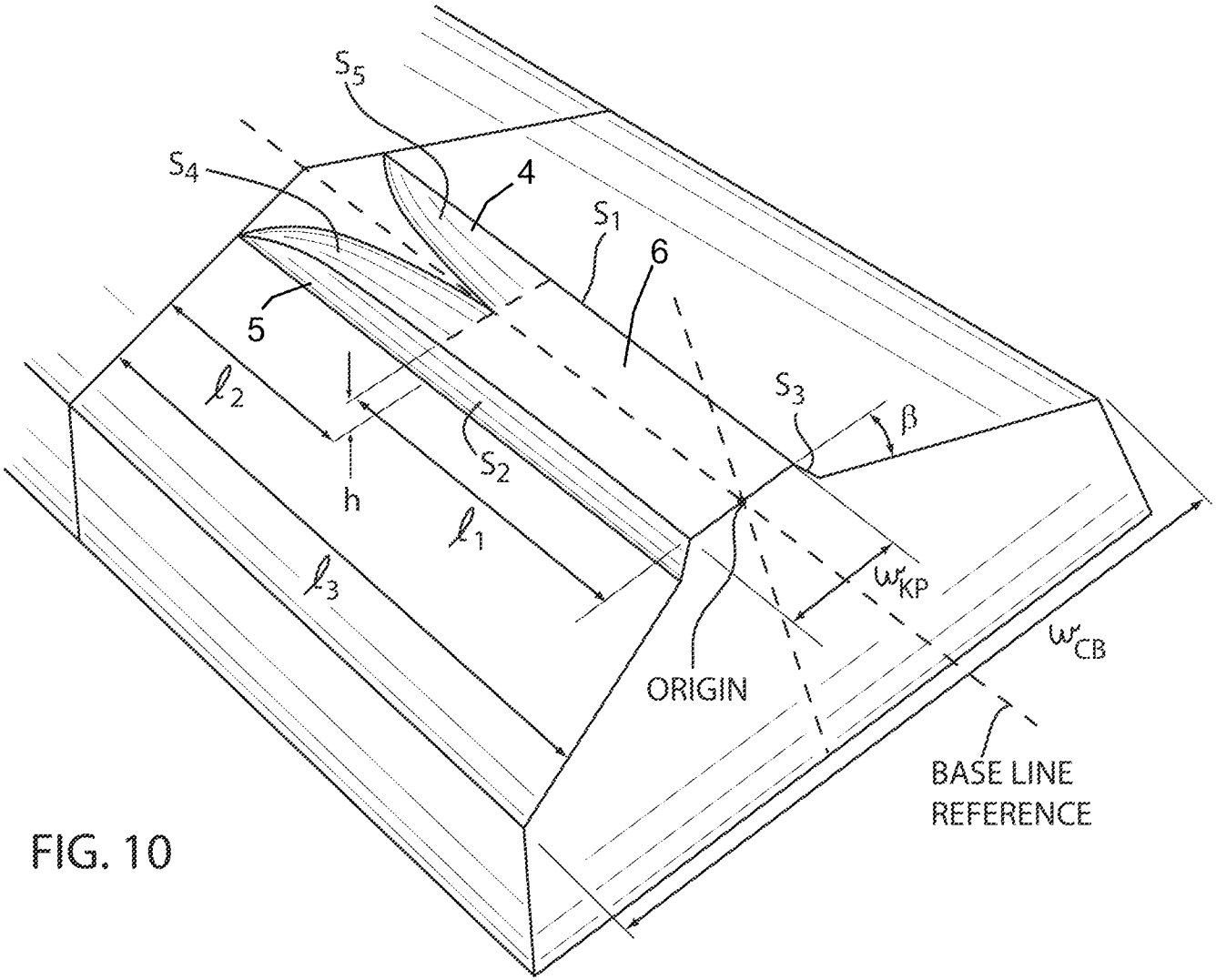
FIG. 10 is a diagrammatic, perspective view of the inventive keel pad according to the invention.

FIG. 10 shows the inventive keel pad 2 and its associated fingers or strakes 4, 5 extending from the main body 6 having a generally rectangular shape S1 until the fingers or strakes 4, 5. The main body 6 has sides S2, S3 and a given length L1. The fingers 4, 5 are curved, scoped or tapered fingers S4, S5 defining an entry surface for the keel pad 2 and each of the fingers 4, 5 has a given length L2. The inner sides of the fingers 4, 5 taper toward each other and have a curved frontal area. The fingers 4, 5 also can be described as a tapering blade shape. The main body 6 has a width $W_{KP}$. The hull 1 has a chine beam width $W_{CB}$, a deadrise angle β and an overall length $L_{OA}$. The keel pad 2 has an overall length L3 where L3=L1+L2.

The sides S2, S3 each have a given height h and the following relationship: h is approximately=0.5 $W_{KP}$ tan (β).

The following proportions hold true:

$$0.05L_{OA}<L3<0.5L_{OA}; \quad a)$$

$$0.05W_{CB}<W_{KP}<0.5L_{OA}; \quad b)$$

$$0.25L1<L2<2L1; \quad c)$$

$$3°<\beta<60°; \quad d)$$

$$1/5>h/L2>1/30; \text{ and} \quad e)$$

$$H \text{ is approximately}=0.5W_{KP}\tan(\beta). \quad f)$$

FIGS. 1, 2 and 10 show the keel pad 2 integrated in the hull 1 of the boat. However, the keel pad 2 can easily be retrofitted onto existing boats where the prior art keel pads are. More specifically, the keel pad 2 is laid over the existing keel pad and attached to the boat.

Figure 11:
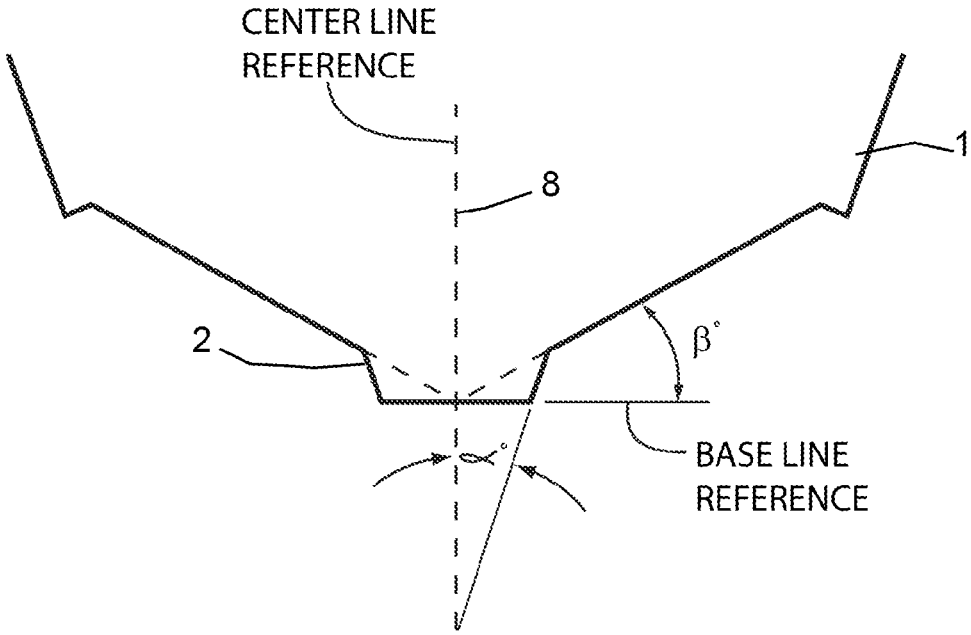
FIG. 11 is a rear view of the keel pad at the transom.

FIG. 11 is a rear view of the keel pad 2 attached to the hull and extending from the transom 7. As can be seen, an angle alpha α describes the angle from a center line 8 to the side S3 of the keel pad. The angle beta β describes the dead rise or angle of the transom. The following relationship holds:

$$\text{Alpha}=2/3(90°-\text{Beta}).$$

The invention claimed is:

1. A keel pad for a V-shaped hull of a boat, the keel pad comprising:

a main body having a forward end; and two strakes extending out only from a front end of said forward end of said main body in a direction of a front of the V-shaped hull, said two strakes being flush with said main body at said forward end, said main body with said two strakes when attached to the V-shaped hull providing hydrodynamic lift due to a bypassing water flow.

2. The keel pad according to claim 1, wherein said two strakes define a V-shaped entry between said two strakes as viewed looking forward toward the front of the hull.

3. The keel pad according to claim 1, wherein said two strakes have inner sides tapering towards each other and are blade shaped.

4. The keel pad according to claim 1, wherein:

said main body has a given width $W_{KP}$;

the hull has a given chine beam width $W_{CB}$ and a given length $L_{OA}$; and said given width $W_{KP}$ is defined by the equation:

$$0.05W_{CB}<W_{KP}<0.5L_{OA}.$$

5. The keel pad according to claim 1, wherein said main body is rectangular shaped.

6. The keel pad according to claim 1, wherein:

said main body has a given length L1;

said strakes each has a given length L2; and said given length L2 is defined by the equation:

$$0.25L1<L2<2L1.$$

7. The keel pad according to claim 1, wherein:

said main body has a given length L1;

said strakes each has a given length L2, where an overall length L3=L1+L2;

the hull has a given length $L_{OA}$; and said overall length L3 is defined by the equation:

$$0.05L_{OA}<L3<0.5L_{OA}.$$

8. The keel pad according to claim 1, wherein the keel pad is designed to be one of:

integrated in the hull; and retrofitted on the hull.

9. The keel pad according to claim 1, wherein said two strakes each have a frontal region sloping towards the hull and extend in a blade like manner to a tip.

10. A boat, comprising:

a V-shaped hull having a front and a transom; and a keel pad extending from said V-shaped hull, said keel pad having a main body with a forward end and two strakes extending out only from a front end of said forward end of said main body in a direction of said front of said V-shaped hull, said two strakes being flush with said main body at said forward end, said main body with said two strakes providing hydrodynamic lift due to a bypassing water flow.

11. The boat according to claim 10, wherein said two strakes define a V-shaped entry between said two strakes as viewed looking forward toward said front of said hull.

12. The boat according to claim 10, wherein said two strakes have inner sides tapering towards each other and are blade shaped.

13. The boat according to claim 10, wherein:

said main body has a given width $W_{KP}$;

said hull has a given chine beam width $W_{CB}$ and a given length $L_{OA}$; and said given width $W_{KP}$ is defined by the equation:

$$0.05W_{CB}<W_{KP}<0.5L_{OA}.$$

14. The boat according to claim 10, wherein said main body is rectangular shaped.

15. The boat according to claim 10, wherein:

said main body has a given length L1;

said strakes each has a given length L2; and said given length L2 is defined by the equation:

$$0.25L1<L2<2L1.$$

16. The boat according to claim 10, wherein:

said main body has a given length L1;

said strakes each has a given length L2, where an overall length L3=L1+L2;

said hull has a given length $L_{OA}$; and said overall length L3 is defined by the equation:

$$0.05L_{OA}<L3<0.5L_{OA}.$$

17. The boat according to claim 10, wherein said two strakes each slope towards said hull in a frontal region of said keel pad.

18. The boat according to claim 10, wherein:

said main body has a given height h and a given width $W_{KP}$;

said hull has a given deadrise angle β; and h is approximately=0.5 $W_{KP}$ tan(β).

19. The boat according to claim 10, wherein:

said main body has a given height h;

said strakes each has a given length L2; and the following equation holds: 1/5>h/L2>1/30.

20. A retrofit kit, comprising:

a keel pad to be attached to a V-shaped hull of a boat, said keel pad containing a main body having a front end and two strakes extending out only from a front end of said forward end of said main body in a direction of a front of the V-shaped hull, said two strakes being flush with said main body at said forward end, said main body with said two strakes providing hydrodynamic lift due to a bypassing water flow.

* * * * *